US009429381B1

(12) United States Patent
Kocmich, IV

(10) Patent No.: US 9,429,381 B1
(45) Date of Patent: Aug. 30, 2016

(54) FIREARM MOUNTING BRACKET ASSEMBLY

(71) Applicant: Edward Kocmich, IV, Keithville, LA (US)

(72) Inventor: Edward Kocmich, IV, Keithville, LA (US)

( * ) Notice: Subject to any disclaimer, the term of this patent is extended or adjusted under 35 U.S.C. 154(b) by 94 days.

(21) Appl. No.: 14/519,676

(22) Filed: Oct. 21, 2014

(51) Int. Cl.
*F41A 23/02* (2006.01)

(52) U.S. Cl.
CPC ..... *F41A 23/02* (2013.01)

(58) Field of Classification Search
CPC ..... F41A 23/00; F41A 23/02; F41A 35/00; F41C 27/00; F41C 27/18; F41C 23/02
USPC ..... 42/90, 124, 127, 106, 94, 96, 71.01, 72, 42/85, 86; 89/37.04; 211/64
See application file for complete search history.

(56) References Cited

U.S. PATENT DOCUMENTS 5,491,920 A * 2/1996 McCullers ..... F41A 23/00 42/94
6,438,888 B1 * 8/2002 Lin ..... F41G 1/34 362/110
6,449,893 B2 * 9/2002 Spinner ..... F41G 11/003 42/124
6,922,934 B1 * 8/2005 Huan ..... F41G 11/003 42/127
6,931,779 B1 * 8/2005 Galuppo, Jr. ..... F41G 11/001 42/114
6,948,690 B1 * 9/2005 Sandel ..... F41B 5/14 124/86
7,543,405 B1 * 6/2009 Ivey ..... F41G 11/003 42/125
8,336,246 B1 * 12/2012 Barber ..... F41G 11/003 42/124
8,650,793 B1 * 2/2014 Mendez ..... F41G 11/003 42/90
8,683,909 B1 * 4/2014 Copus ..... F41A 23/16 182/127
8,898,949 B1 * 12/2014 Greenwood ..... F41G 1/387 42/124
2008/0157607 A1 * 7/2008 Scheich ..... F16C 29/001 310/12.25
2010/0018102 A1 * 1/2010 Minges ..... A01M 31/02 42/94
2011/0302819 A1 * 12/2011 McGhan ..... F41B 5/14 42/94

* cited by examiner

*Primary Examiner* — Jonathan C Weber
(74) *Attorney, Agent, or Firm* — R. Keith Harrison

(57) ABSTRACT

A firearm mounting bracket assembly includes an assembly mount bracket; an assembly mounting mechanism carried by the assembly mount bracket; and an accessory rail adaptor including an adaptor body carried by the assembly mount bracket, the adaptor body having a firearm attachment surface; an adaptor roller carried by the adaptor body adjacent to the firearm attachment surface; and an adaptor flange carried by the adaptor body adjacent to the firearm attachment surface and in spaced-apart relationship to the adaptor roller, the adaptor flange selectively moveable relative to the adaptor roller.

17 Claims, 8 Drawing Sheets

FIREARM MOUNTING BRACKET ASSEMBLY

CROSS-REFERENCE TO RELATED APPLICATIONS

This application is related to co-pending application Ser. No. 14/461,699, filed Aug. 18, 2014 and entitled ACCESSORY RAIL ADAPTOR, which application is incorporated by reference herein in its entirety.

FIELD

Illustrative embodiments of the disclosure generally relate to firearms. More particularly, illustrative embodiments of the disclosure relate to a firearm mounting bracket assembly which facilitates mounting of a firearm to a tree, pole or other support for steady and sustained aiming and firing of the firearm as well as enables use of the support as a shield from projectiles in the event of return fire.

BACKGROUND

The background description provided herein is solely for the purpose of generally presenting the context of various illustrative embodiments of the disclosure. Aspects of the background description are neither expressly nor impliedly admitted as prior art against the claimed subject matter.

Semiautomatic and automatic firearms are often used by police and military personnel. In shootout or combat situations, it may be necessary for police or military personnel to hold, aim and shoot a firearm for prolonged periods of time. However, the police or military personnel may be required to steady the firearm using his or her hands, and this may compromise the shooting accuracy of the firearm as well as tire the personnel during the operation. Additionally, in the event of return fire, the personnel may seek shelter from projectiles by hiding behind a tree, pole or other shielding object.

Accordingly, a firearm mounting bracket assembly which facilitates mounting of a firearm to a tree, pole or other support for steady and sustained aiming and firing of the firearm and enables use of the support as a shield from projectiles in the event of return fire may be desirable in some applications.

SUMMARY

Illustrative embodiments of the disclosure are generally directed to a firearm mounting bracket assembly which facilitates mounting of a firearm to a tree, pole or other support for steady and sustained aiming and firing of the firearm as well as enables use of the support as a shield from projectiles in the event of return fire. An illustrative embodiment of the firearm mounting bracket assembly includes an assembly mount bracket; an assembly mounting mechanism carried by the assembly mount bracket; and an accessory rail adaptor including an adaptor body carried by the assembly mount bracket, the adaptor body having a firearm attachment surface; an adaptor roller carried by the adaptor body adjacent to the firearm attachment surface; and an adaptor flange carried by the adaptor body adjacent to the firearm attachment surface and in spaced-apart relationship to the adaptor roller, the adaptor flange selectively moveable relative to the adaptor roller.

BRIEF DESCRIPTION OF THE DRAWINGS

Illustrative embodiments of the disclosure will now be described, by way of example, with reference to the accompanying drawings, in which.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the claims. Moreover, the illustrative embodiments described herein are not exhaustive and embodiments or implementations other than those which are described herein and which fall within the scope of the appended claims are possible. Furthermore, there is no intention to be bound by any expressed or implied theory presented in the preceding technical field, background, brief summary or the following detailed description. As used herein, relative terms such as "upper", "lower", "side" and "end" are intended to be used in an illustrative and not a limiting sense. In some applications, for example, those elements which are identified as "lower" may be located in other spatial relationships relative to those elements which are identified as "lower" in the following detailed description.

Figure 3:
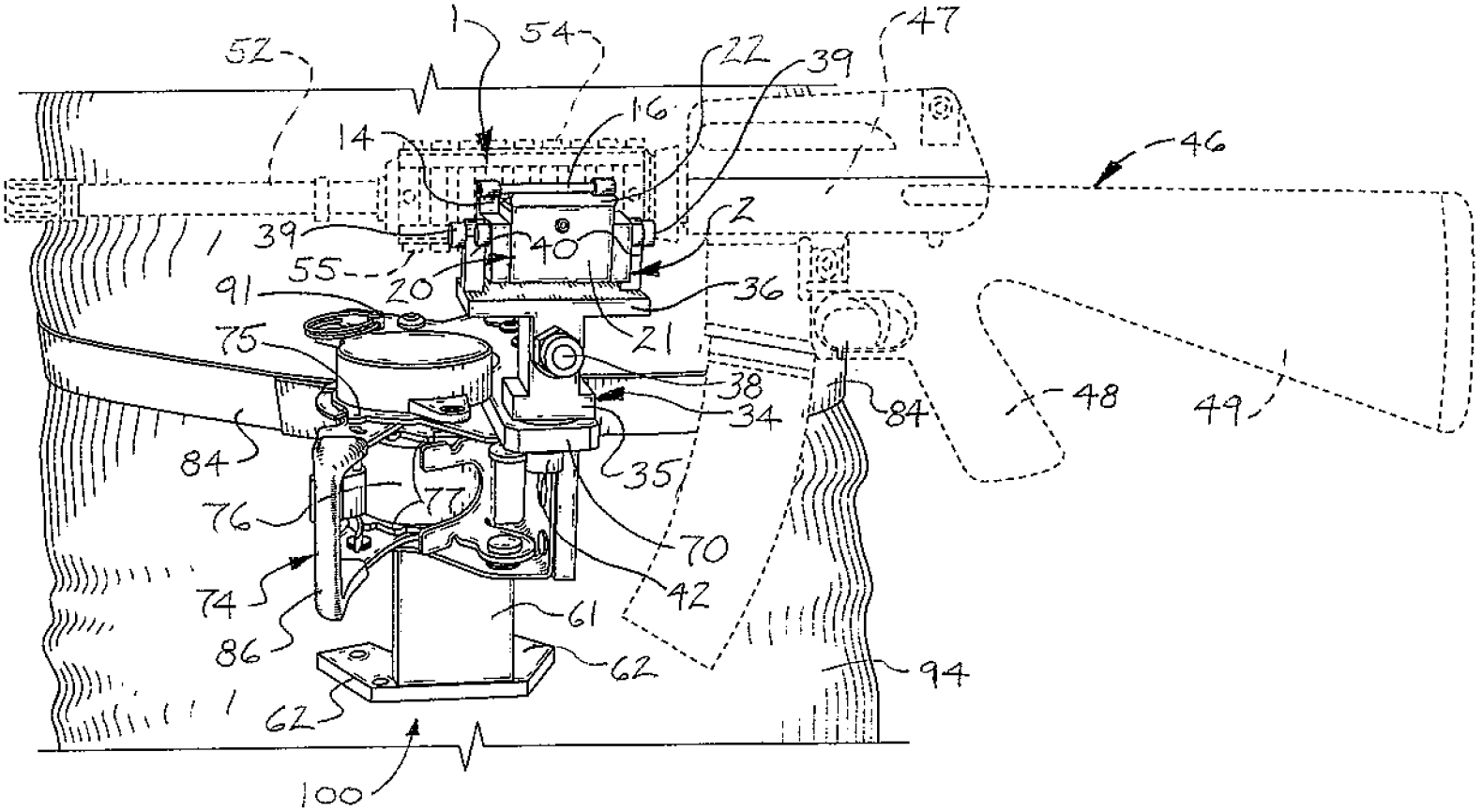
FIG. 3 is a side view of the illustrative firearm mounting bracket assembly mounted on a tree and a firearm (illustrated in phantom) mounted on the firearm mounting bracket assembly in typical application of the assembly.

Referring to the drawings, an illustrative embodiment of the firearm mounting bracket assembly, hereinafter assembly, is generally indicated by reference numeral 100. As illustrated in FIG. 3, in typical application, as will be hereinafter described, the assembly 100 may be attached to a support 94 such as a tree, telephone pole or the like. A firearm 46 can be expeditiously attached to and supported by the assembly 100 for aiming and firing of the firearm 46 at a target (not illustrated). The assembly 100 holds the firearm 46 steady and enables an operator to accurately aim and shoot the firearm 46 at the target in a sustained manner without tiring, as well as enables the firearm operator to use the support 94 as a shield from projectiles in the event of return fire, particularly in military or law enforcement applications.

Figure 1:
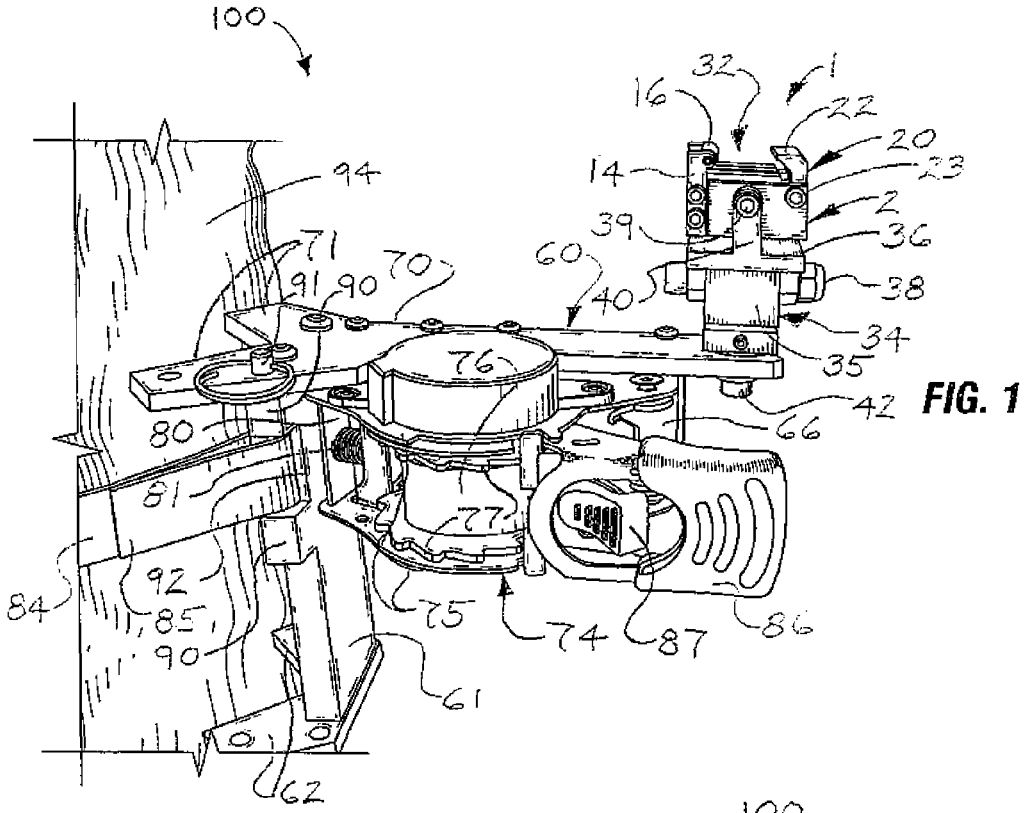
FIG. 1 is a front perspective view of an illustrative embodiment of the firearm mounting bracket assembly mounted on a tree in typical application of the assembly.
Figure 2:
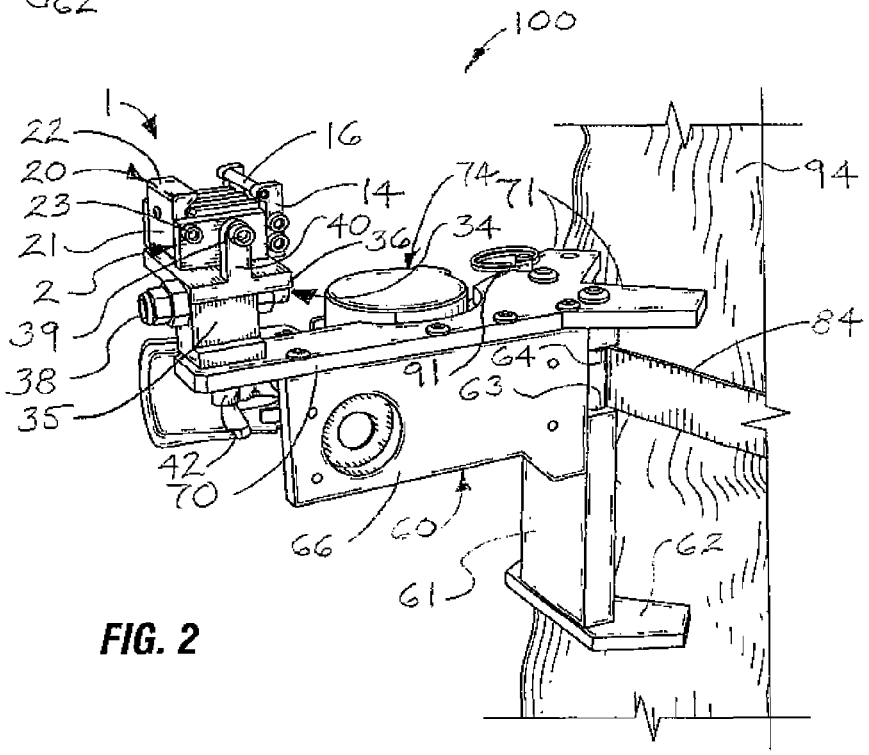
FIG. 2 is a rear perspective view of the illustrative firearm mounting bracket assembly mounted on a tree in typical application of the assembly.

The assembly 100 may include an assembly mount bracket 60 which is adapted for attachment to the support 94. The assembly mount bracket 60 may include a support engaging member 61 adapted to engage the support 94. A pair of spaced-apart support engaging arms 62 may extend from the support engaging member 61. A mounting mechanism plate 66 may extend from the support engaging member 61. The mounting mechanism plate 66 may be disposed in perpendicular relationship to the support engaging member 61. As illustrated in FIG. 2, a strap roller slot 63 may be provided in the support engaging member 61 at the junction between the support engaging member 61 and the mounting mechanism plate 66. A strap roller 64 may be mounted for rotation in the strap roller slot 63 for purposes which will be hereinafter described. As illustrated in FIG. 1, a pair of spaced-apart strap pin flanges 90 may extend from the support engaging member 61. A strap pin slot 92 may be provided between the strap pin flanges 90 opposite the strap roller slot 63 (FIG. 2). A strap pin 91 can be selectively and removably inserted in a pair of registering strap pin openings (not illustrated) in the respective strap pin flanges 90 to span the strap pin slot 92 for purposes which will be hereinafter described.

An accessory rail adaptor mount plate 70 may be provided on the mounting mechanism plate 66. The accessory rail adaptor mount plate 70 may be disposed in perpendicular relationship to the mounting mechanism plate 66. A pair of spaced-apart support engaging arms 71 may extend from the mechanism mounting plate 66 in spaced-apart relationship to the support engaging arms 62 on the support engaging member 61. The support engaging member 61, mounting mechanism plate 66, accessory rail adaptor mount plate 70 and various other components of the assembly mount bracket 60 may include metal such as aluminum or steel and/or a composite material such as carbon fiber composite or plastic, for example and without limitation.

Figure 4:
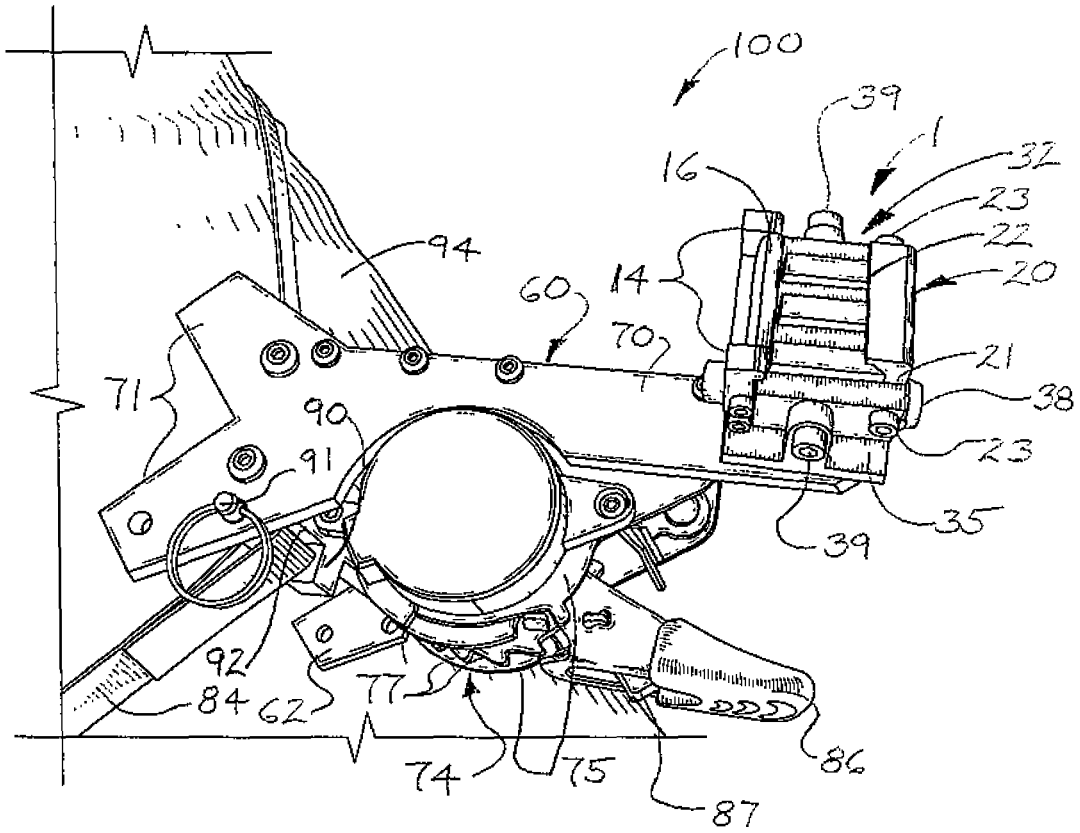
FIG. 4 is a top perspective view of the illustrative firearm mounting bracket assembly mounted on a tree.
Figure 5:
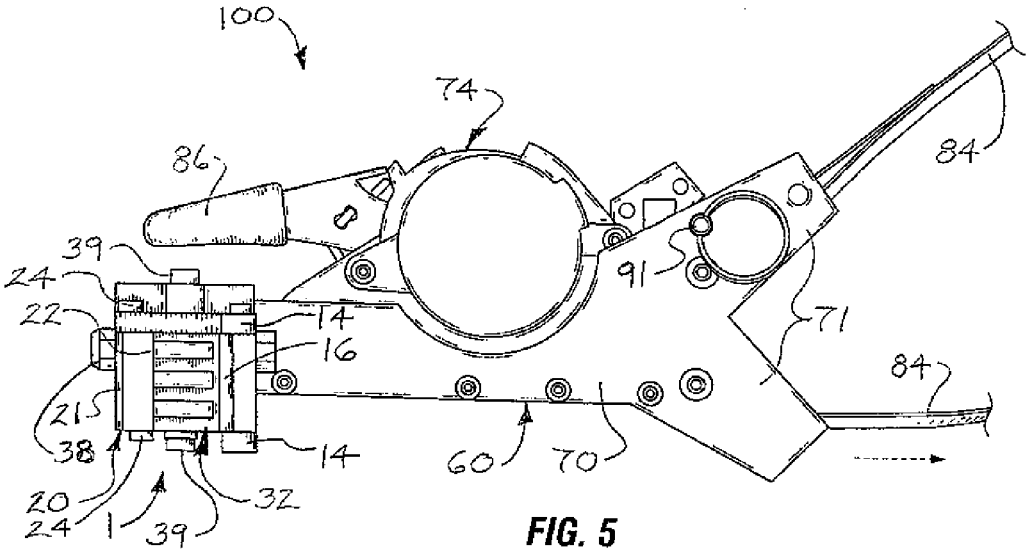
FIG. 5 is a top view of the illustrative firearm mounting bracket assembly, more particularly illustrating loosening of a assembly securing strap which facilitates attachment of the assembly to a tree (not illustrated) or other support.
Figure 6:
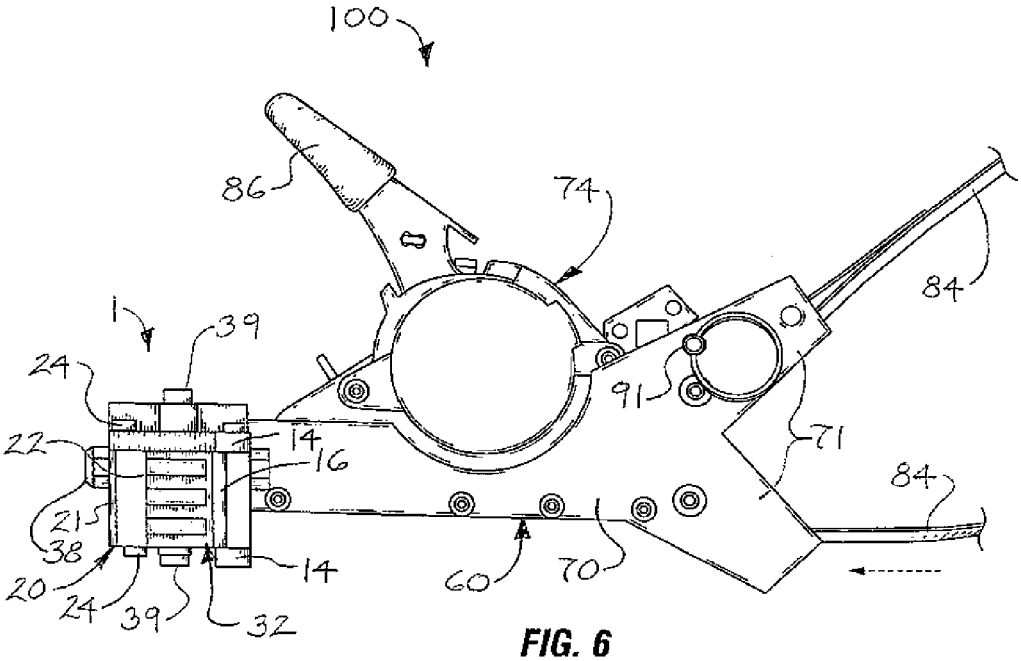
FIG. 6 is a top view of the illustrative firearm mounting bracket assembly, more particularly illustrating tightening of the assembly securing strap.

An assembly mounting mechanism 74 may be provided on the assembly mount bracket 60 to facilitate attachment of the assembly 100 to the support 94. The assembly mounting mechanism 74 may include any apparatus, device or mechanism which is suitable for the purpose of attaching the assembly mount bracket 60 to the support 94. As illustrated in FIGS. 1, 3 and 4, in some embodiments, the assembly mounting mechanism 74 may include a ratchet mechanism which may be standard or conventional. In some embodiments, the ratchet mechanism 74 may include a ratchet frame 75 which may be mounted to the accessory rail adaptor mount plate 70 using mechanical fasteners and/or other suitable technique known by those skilled in the art. A rotatable ratchet drum 76 may be mounted in the ratchet frame 75. Ratchet teeth 77 may be provided on the ratchet drum 76. An assembly securing strap 84 may be wound on the ratchet drum 76. The assembly securing strap 84 may extend from the ratchet drum 76 through the strap roller slot 63 and against the strap roller 64 (FIG. 2). The extending end of the assembly securing strap 84 may be formed and sewn into a strap loop 85 which is detachably attached to the strap pin 91 removably seated in the strap pin slot 92, as illustrated in FIG. 1. A ratchet tab 80 may be mounted on the ratchet frame 75. A ratchet tab spring 81 may normally bias the ratchet tab 80 into engagement with the ratchet teeth 77 on the ratchet drum 76 to enable rotation of the ratchet drum 76 in a first rotational direction and prevent rotation of the ratchet drum 76 in a second rotational direction. A ratchet handle 86 may operably engage the ratchet drum 76 for rotation of the ratchet drum 76 in the first direction by back-and-forth manipulation of the ratchet handle 86, typically in the conventional manner, to facilitate selective winding of the assembly securing strap 84 on the ratchet drum 76, as illustrated in FIG. 6. A ratchet release button 87 may operably engage the ratchet drum 76 to release the ratchet drum 76 and facilitate selective extension of the assembly securing strap 84 from the ratchet drum 76, as illustrated in FIG. 5.

In typical application of the assembly 100, which will be hereinafter further described, the assembly 100 may be mounted on the support 94 by initially detaching the strap loop 85 on the assembly securing strap 84 from the strap pin 91 by removing the strap pin 91 from the registering strap pin openings (not illustrated) in the respective strap pin flanges 90. The support engaging arms 62, 71 may be placed against the support 94, after which the assembly securing strap 84 may be extended from the ratchet drum 76, as illustrated in FIG. 5, typically by depressing the ratchet release button 87. The loose strap loop 85 on the assembly securing strap 84 may be extended around the support 94 and then re-attached to the strap pin 91 in the strap pin slot 92 by placing the strap loop 85 in the strap pin slot 92 and re-inserting the strap pin 91 in the registering strap pin openings (not illustrated) in the respective strap pin flanges 90 through the registering strap loop 85. The ratchet handle 86 may be manipulated in the back-and-forth motion to wind the assembly securing strap 84 on the ratchet drum 76 until the assembly securing strap 84 tightens around the support 94, the support engaging arms 62, 71 snugly engage the support 94 and the assembly mount bracket 60 is oriented in a horizontal position above the ground (not illustrated).

Figure 11:
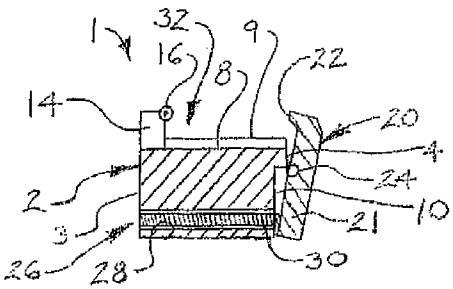
FIG. 11 is a cross-sectional view, taken along section lines 10-10 in FIG. 9, with the adaptor flange on the accessory rail adaptor deployed in a rail unlocking position.
Figure 10:
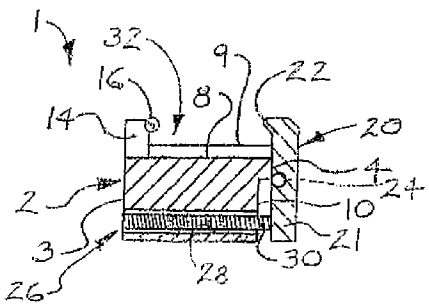
FIG. 10 is a cross-sectional view, taken along section lines 10-10 in FIG. 9, with the adaptor flange on the accessory rail adaptor deployed in a rail locking position.

An accessory rail adaptor 1 may be provided on the accessory rail adaptor mount plate 70 of the assembly mount bracket 60. As illustrated in FIG. 3, in typical application, which will be hereinafter described, the accessory rail adaptor 1 may facilitate expeditious attachment of a firearm 46 to the assembly 100 and detachment of the firearm 46 from the assembly 100. As particularly illustrated in FIGS. 7-11, the accessory rail adaptor 1 may include an adaptor body 2. The adaptor body 2 and other components of the accessory rail adaptor 1, which will be hereinafter described, may include metal such as aluminum or steel and/or a composite material such as carbon fiber composite or plastic, for example and without limitation. As illustrated in FIGS. 9-11, the adaptor body 2 may include a first adaptor body side surface 3; a second adaptor body side surface 4 which is opposite the first adaptor body side surface 3; and a first adaptor body end 5 and a second adaptor body end 6 at opposite ends of the adaptor body 2. The adaptor body 2 may further include a firearm attachment surface 8. In some embodiments, multiple adaptor ridges 9 may extend from the firearm attachment surface 8 in generally parallel, spaced-apart relationship to each other for purposes which will be hereinafter described.

An adaptor roller 16 is provided on the adaptor body 2. The adaptor roller 16 is disposed adjacent to the firearm attachment surface 8 of the adaptor body 2. An adaptor flange 20 is provided on the adaptor body 2. The adaptor flange 20 is disposed adjacent to the firearm attachment surface 8 and in spaced-apart relationship to the adaptor roller 16. As illustrated in FIGS. 10 and 11, the adaptor flange 20 is selectively moveable toward and away from the adaptor roller 16 such as in a manner and for a purpose which will be hereinafter described.

The adaptor roller 16 may be mounted on the adaptor body 2 according to any suitable technique which is known by those skilled in the art. As particularly illustrated in FIG. 9, in some embodiments, a pair of spaced-apart roller mount arms 14 may extend from the adaptor body 2 at the first adaptor body side surface 3. The roller mount arms 14 may be secured to the adaptor body 2 via arm fasteners 15. The roller mount arms 14 may protrude beyond the firearm attachment surface 8 of the adaptor body 2. The adaptor roller 16 may be journaled for rotation between the roller mount arms 14 according to the knowledge of those skilled in the art.

The adaptor flange 20 may be mounted for selective movement toward and away from the adaptor roller 16 according to any suitable technique which is known by those skilled in the art. As illustrated in FIGS. 10 and 11, in some embodiments, the adaptor flange 20 may be pivotally attached to the second adaptor body side surface 4 of the adaptor body 2 via a flange mount shaft 24. The flange mount shaft 24 may be secured at each end via a pair of flange fasteners 23 (FIG. 9). Accordingly, the adaptor flange 20 may be selectively pivotal between a locking position illustrated in FIG. 10, in which the adaptor flange 20 is oriented toward the adaptor roller 16, and a release position illustrated in FIG. 11, in which the adaptor flange 20 is oriented away from the adaptor roller 16. As illustrated in FIG. 11, a flange pivot space 10 may be provided in the second adaptor body side surface 4 of the adaptor body 2 to accommodate the adaptor flange 20 in the release position.

In some embodiments, a flange biasing mechanism 26 may be provided on the adaptor body 2 in engagement with the adaptor flange 20. The flange biasing mechanism 26 may include any type of biasing device or mechanism which normally biases the adaptor flange 20 in the locking position on the adaptor body 2. For example and without limitation, in some embodiments, the flange biasing mechanism 26 may include a coiled flange bias spring 30. As illustrated in FIGS. 10 and 11, the flange bias spring 30 may be disposed in a spring cavity 28 which extends through the adaptor body 2 from the first adaptor body side surface 3 to the second adaptor body side surface 4 and protrudes beyond the adaptor body side surface 4 to engage the adaptor flange 20.

In some embodiments, the adaptor flange 20 may include an adaptor flange body 21 which is pivotally attached to the adaptor body 2 such as via the flange mount shaft 24. An adaptor flange tab 22 may protrude from the adaptor flange body 21 adjacent to the firearm attachment surface 8 of the adaptor body 2. A rail lock space 32 may be formed by and between the firearm attachment surface 8 of the adaptor body 2, the adaptor roller 16 and the adaptor flange body 21 and the adaptor flange 22 of the adaptor flange 20 for purposes which will be hereinafter described.

Figure 14:
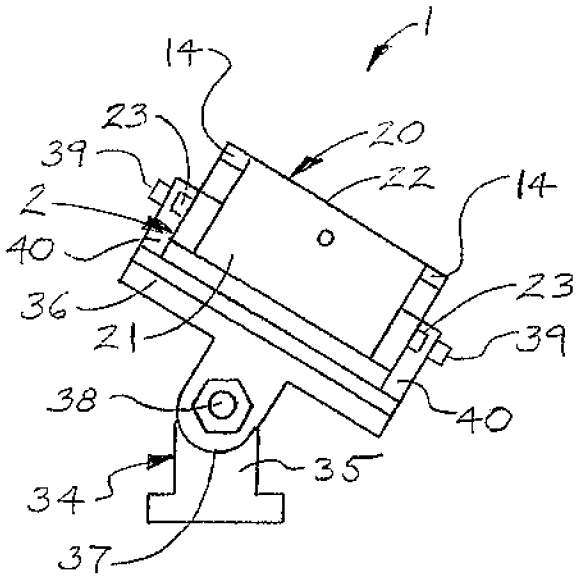
FIG. 14 is a side view of the accessory rail adaptor mounted on an adaptor mount bracket and pivoted to the right on the adaptor mount bracket.
Figure 13:
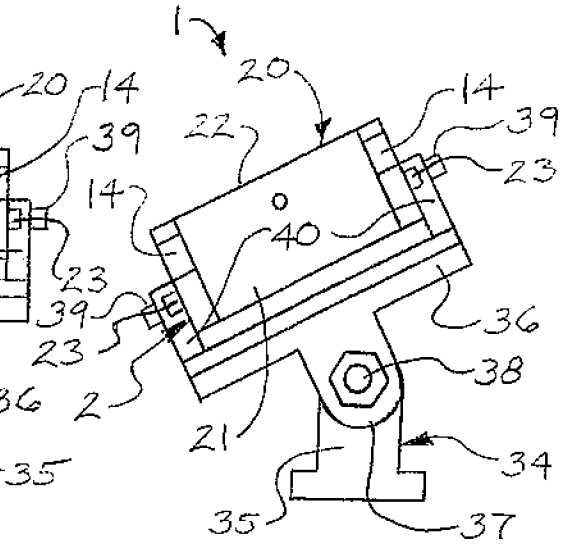
FIG. 13 is a side view of the accessory rail adaptor mounted on an adaptor mount bracket and pivoted to the left on the adaptor mount bracket.
Figure 12:
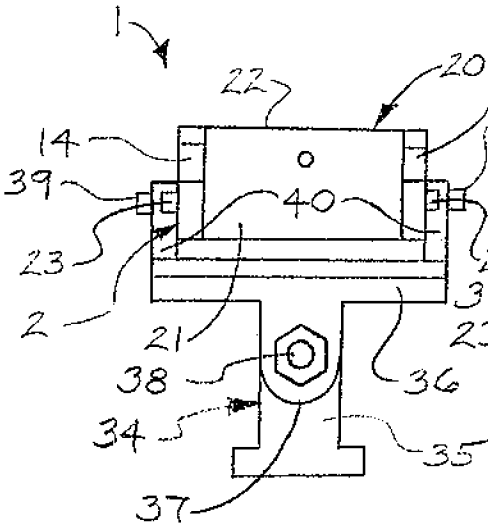
FIG. 12 is a side view of the accessory rail adaptor mounted on an adaptor mount bracket and deployed in an upright position.

The adaptor body 2 of the accessory rail adaptor 1 may be attached to the accessory rail adapter mount plate 70 of the assembly mount bracket 60 according to any suitable attachment technique which is known by those skilled in the art. As particularly illustrated in FIG. 3, in some embodiments, an adaptor mount bracket 34 may attach the adaptor body 2 to the accessory rail adapter mount plate 70. As illustrated in FIGS. 12-14, the adaptor mount bracket 34 may include a bracket pedestal 35 which may be attached to the accessory rail adapter mount plate 70. In some embodiments, the bracket pedestal 35 may be mounted in a rotatable manner with respect to the adaptor mount plate 70 such as via a pedestal mount fastener 42. A bracket platform 36 may be pivotally attached to the bracket pedestal 35 such as via a bracket mount bolt 38 which extends through at least one bolt opening (not illustrated) in at least one platform 37 protruding from the bracket platform 36 and through a registering bolt opening (not illustrated) in the bracket pedestal 35. A pair of spaced-apart bracket arms 40 may extend from the bracket platform 36. The adaptor body 2 may be pivotally mounted between the bracket arms 40 via a pair of bracket fasteners 39. Thus, the bracket platform 36 may be selectively pivoted with respect to the bracket pedestal 35 about a first pivot axis defined by the bracket mount bolt 38, as illustrated in FIGS. 12-14, and the adaptor body 2 may be selectively pivoted with respect to the bracket arms 40 about the bracket fasteners 39 along a second pivot axis which is perpendicular to the first pivot axis of the bracket mount bolt 38 to facilitate multi-positioning capability of the firearm 46 mounted on the accessory rail adaptor 1.

In typical application, the assembly 100 facilitates mounting of a firearm 46 (illustrated in phantom in FIG. 3) to a tree, pole or other support 94 for steady and sustained aiming and firing of the firearm 46 as well as use of the support 94 as a shield from projectiles in the event of return fire. Accordingly, the assembly 100 may be mounted on the support 94 by placing the support engaging arms 62, 71 on the assembly mount bracket 60 against the support 94 and extending and tightening the assembly securing strap 84 around the support 94 by operation of the assembly mounting mechanism 74, as was heretofore described with respect to FIGS. 1-6. The firearm 46 is attached to the accessory rail adaptor 1 preparatory to aiming and firing the firearm 46 at a target (not illustrated). As illustrated in FIG. 3, in some applications, the firearm 46 may be a standard or conventional automatic or semiautomatic rifle having a firearm receiver 47, a rear grip 48 and a stock 49 extending from the firearm receiver 47 and a barrel 52 extending forwardly from the firearm receiver 47. The upper accessory mount rail 54 and the lower accessory mount rail 55 may extend along the barrel 52. The upper accessory mount rail 54 and the lower accessory mount rail 55 may each be a conventional Weaver rail mount or Picatinny mount (such as a mil-standard 1913 rail), for example and without limitation.

Figure 8:
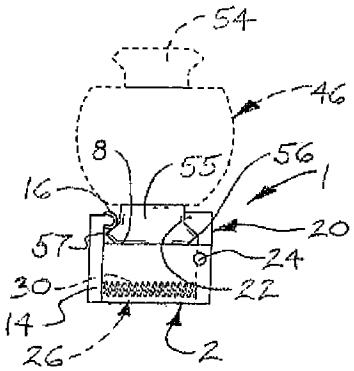
FIG. 8 is a front view of the accessory rail adaptor, more particularly illustrating completing attachment of the lower accessory mount rail on the firearm to the accessory rail adaptor by inserting a second lateral rail edge of the lower accessory mount rail beneath an adaptor roller on the adaptor.
Figure 7:
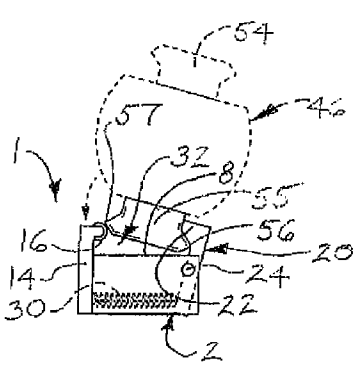
FIG. 7 is a front view of a typical accessory rail adaptor of an illustrative firearm mounting bracket assembly, more particularly illustrating attachment of a lower accessory mount rail on a firearm (illustrated in phantom) to the accessory rail adaptor by initially inserting a first lateral rail edge of the lower accessory mount rail beneath an adaptor flange on the adaptor.
Figure 9:
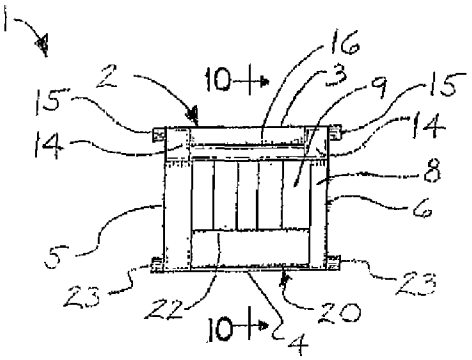
FIG. 9 is top view of the accessory rail adaptor.

As illustrated in FIGS. 7 and 8, the lower accessory mount rail 55 on the firearm 46 may be attached to the accessory rail adaptor 1 as follows. The adaptor flange 20 is initially pivoted from the locking position illustrated in FIG. 10 to the release position illustrated in FIG. 11 against the bias imparted by the flange biasing mechanism 26. As illustrated in FIG. 7, as the lower accessory mount rail 55 is oriented at an angled position relative to the adaptor body 2, a first lateral rail edge 56 of the lower accessory mount rail 55 is then inserted between the firearm attachment surface 8 on the adaptor body 2 and the adaptor flange tab 22 on the adaptor flange 20. As illustrated in FIG. 8, a second lateral edge 57 of the lower accessory mount rail 55 is then pushed against the adaptor roller 16, which rotates between the roller mount arms 14 until the second lateral edge 57 snaps into place between the adaptor roller 16 and the firearm attachment surface 8 of the adaptor body 2 as the flange biasing mechanism 26 returns the adaptor flange 20 to the locking position illustrated in FIG. 10. Accordingly, the lower accessory mount rail 55 is securely seated in the rail lock space 32 (FIG. 7) against the firearm attachment surface 8 of the adaptor body 2.

As the assembly 100 remains securely fastened to the support 94 and the firearm 46 remains securely fastened to the assembly 100, the firearm operator (not illustrated) aims and fires the firearm 46 toward the target. It will be appreciated by those skilled in the art that the firearm 46 remains steady and immovable throughout operation as the firearm operator repeatedly fires the firearm 46 at the target. Additionally, due to the typical universal positioning capability of the adaptor mount bracket 34, the firearm operator can rotate the firearm 46 as the bracket pedestal 35 rotates about the pedestal mount fastener 42 as well as pivot the firearm 46 in a side-to-side motion as the adaptor body 2 pivots about the bracket fasteners 39 and angle the firearm 46 along the desired vertical aiming trajectory as the bracket platform 36 pivots about the bracket mount bolt 38. In the event of return fire, such as may occur in law enforcement or military applications, the firearm operator can shield himself or herself from projectiles by standing or crouching behind the support 94. Moreover, the accessory rail adaptor 1 prevents rearward recoil motion of the firearm 46 relative to the accessory rail adaptor mount plate 70 by securely immobilizing the lower accessory mount rail 55 on the firearm 46 during shooting.

The firearm 46 can be selectively detached from the accessory rail adaptor 1 by disengaging the second lateral rail edge 57 of the lower accessory mount rail 55 from the firearm attachment surface 8 of the adaptor body 2 while rotating the second lateral edge 57 against the adaptor roller 16 and then removing the first lateral rail edge 56 of the lower accessory rail mount 55 from the rail lock space 32, in a reverse of the steps which were heretofore described with respect to attachment of the firearm 46 to the accessory rail adaptor 1 in FIGS. 7 and 8. The assembly mount bracket 60 can be selectively removed from the support 94 typically by depression of the ratchet release button 86 on the assembly mounting mechanism 74 to release the ratchet drum 76 and pulling the assembly securing strap 84 from the ratchet drum 76, as illustrated in FIG. 5, as the ratchet drum 76 rotates to loosen the assembly securing strap 84. Next, the strap pin 91 may be removed from the strap pin openings (not illustrated) in the strap pin flanges 90 (FIG. 1) of the assembly mount bracket 60 to remove the strap loop 85 from the strap pin slot 92 and then the assembly securing strap 84 from around the support 94.

Figure 15:
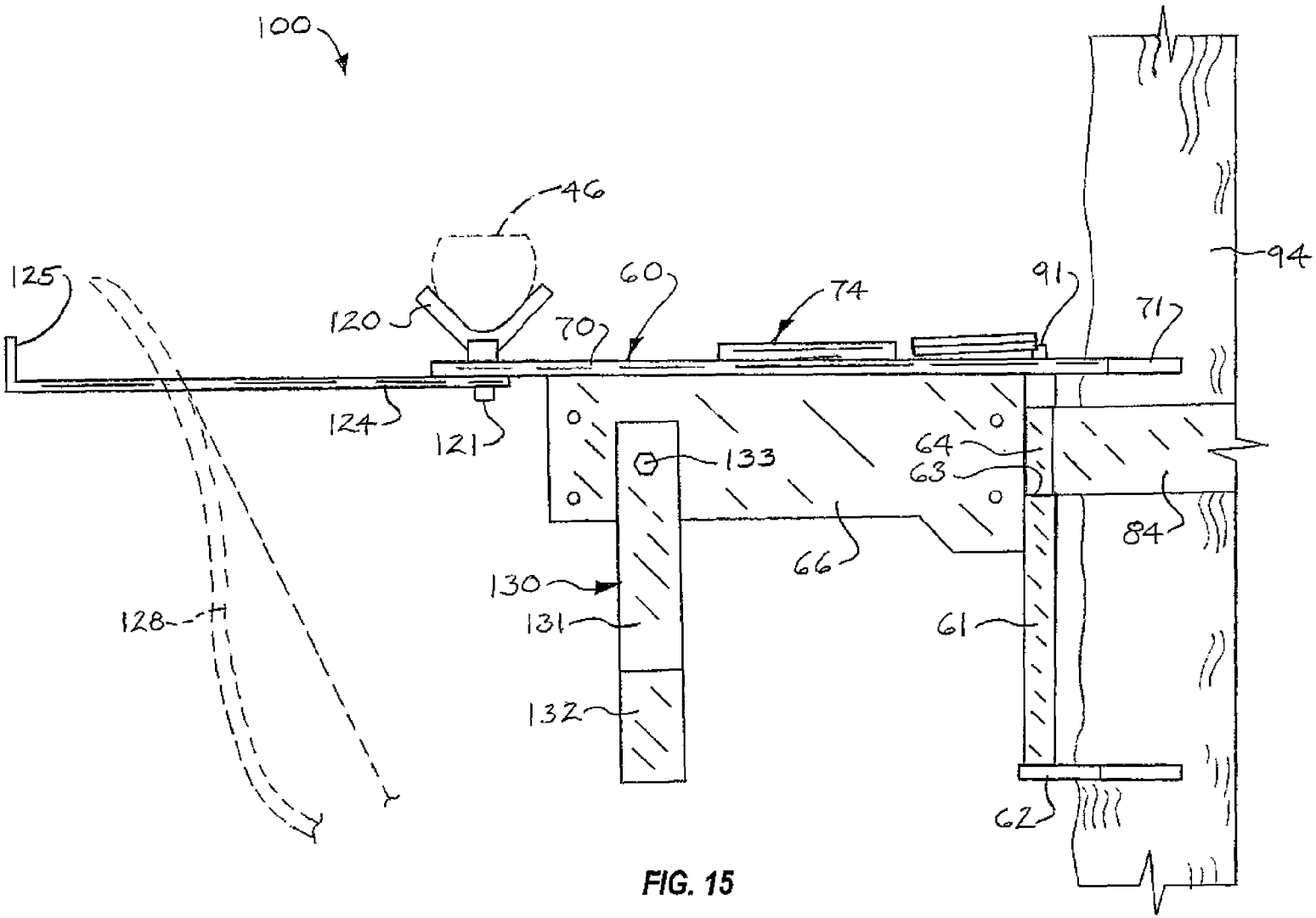
FIG. 15 is a side view of the illustrative firearm mounting bracket assembly with a firearm support cradle, a bow mount arm and an accessory mount hook on the assembly mount bracket for supporting a firearm, a bow and an accessory, respectively.
Figure 16:
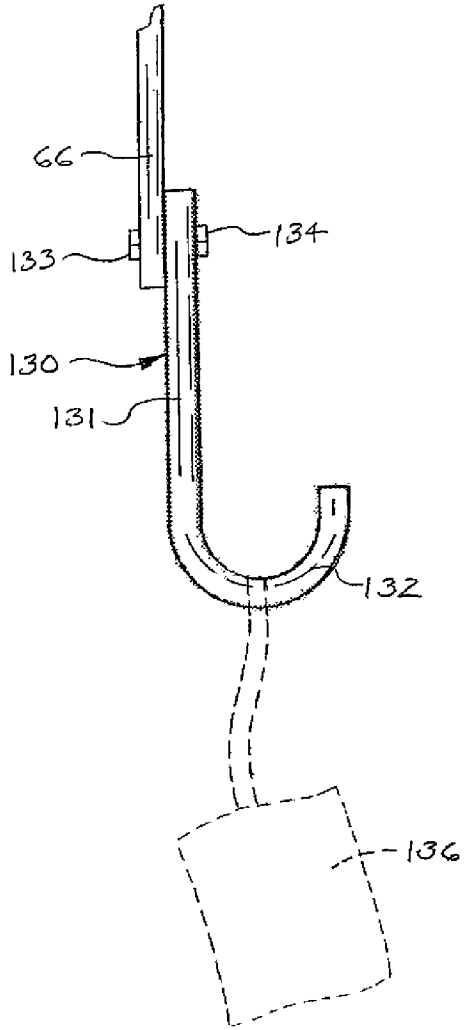
FIG. 16 is a side view of a typical accessory mount hook of the illustrative firearm mounting bracket assembly illustrated in FIG. 15, with an accessory suspended from the accessory mount hook.

Referring next to FIGS. 15 and 16 of the drawings, an illustrative embodiment of the assembly 100 includes a firearm support cradle 120 which is provided on the accessory rail adaptor mount plate 70 of the assembly mount bracket 60 in place of the accessory rail adaptor 1 which was heretofore described with respect to FIGS. 1-14. The accessory rail adaptor 1 and the firearm support cradle 120 may be detachably and interchangeably attached to the assembly mount bracket 60. The firearm support cradle 120 may be attached to the accessory rail adaptor mount plate 70 via cradle mount bolt 121 which may facilitate selective rotational adjustment of the firearm support cradle 120. Accordingly, as illustrated in FIG. 15, in application of the assembly 100, the firearm support cradle 120 may support a firearm 46 for steady and sustained aiming and firing of the firearm 46. The firearm support cradle 120 may facilitate multi-positioning capability of the firearm 46 as the firearm support cradle 120 is rotated via the cradle mount bolt 121.

In some embodiments, a bow mount arm 124 may extend from the assembly mount bracket 60. The bow mount arm 124 may be attached to the accessory rail adaptor mount plate 70 via the cradle mount bolt 121. A retainer flange 125 may terminate the extending or distal end of the bow mount arm 124. Accordingly, as illustrated in FIG. 15, in application of the assembly 100, a bow 128 (illustrated in phantom) may be suspended from the bow mount arm 124 when not in use. The retainer flange 125 prevents the bow 128 from inadvertently sliding from the bow mount arm 124.

In some embodiments, an accessory mount hook 130 may be attached to the assembly mount bracket 60. The accessory mount hook 130 may include a hook shaft 131 which may be attached to the mounting mechanism plate 66 of the assembly mount bracket 60 via a hook mount bolt 133 and securing not 134. A curved hook bottom segment 132 may extend from the hook shaft 131. As illustrated in FIG. 16, an accessory 136 such as a bag, sack or the like containing items (not illustrated) such as ammunition may be suspended from the accessory mount hook 130 for ease of access by the operator of the firearm 46 in application of the assembly 100.

While the preferred embodiments of the disclosure have been described above, it will be recognized and understood that various modifications can be made in the disclosure and the appended claims are intended to cover all such modifications which may fall within the spirit and scope of the disclosure.

What is claimed is:

1. A firearm mounting bracket assembly, comprising:

an assembly mount bracket;

an assembly mounting mechanism carried by the assembly mount bracket; wherein the assembly mounting mechanism comprises a ratchet mechanism and an assembly securing strap engaged by the ratchet mechanism, the ratchet mechanism operable to selectively tighten and loosen the assembly securing strap; and an accessory rail adaptor including:

an adaptor body carried by the assembly mount bracket, the adaptor body having a firearm attachment surface;

an adaptor roller carried by the adaptor body adjacent to the firearm attachment surface; and an adaptor flange carried by the adaptor body adjacent to the firearm attachment surface and in spaced-apart relationship to the adaptor roller, the adaptor flange selectively moveable relative to the adaptor roller.

2. The firearm mounting bracket assembly of claim 1 wherein the assembly mount bracket comprises a support engaging member and a mounting mechanism plate carried by the support engaging member, and the assembly mounting mechanism is carried by the mounting mechanism plate.

3. The firearm mounting bracket assembly of claim 2 further comprising an accessory rail adaptor mount plate carried by the support engaging member, and wherein the accessory rail adaptor is carried by the accessory rail adaptor mount plate.

4. The firearm mounting bracket assembly of claim 3 further comprising an adaptor mount bracket carried by the accessory rail adaptor mount plate, and wherein the adaptor body of the accessory rail adaptor is carried by the adaptor mount bracket.

5. The firearm mounting bracket assembly of claim 4 wherein the adaptor mount bracket comprises a rotatable bracket pedestal carried by the accessory rail adaptor mount plate and a bracket platform pivotally carried by the bracket pedestal along a first pivot axis, and wherein the adaptor body of the accessory rail adaptor is pivotally carried by the bracket platform along a second pivot axis generally perpendicular to the first pivot axis.

6. The firearm mounting bracket assembly of claim 3 further comprising a first pair of spaced-apart support engaging arms carried by the support engaging member and a second pair of spaced-apart support engaging arms carried by the accessory rail adaptor mount plate.

7. The firearm mounting bracket assembly of claim 1 wherein the adaptor flange is pivotally carried by the adaptor body of the accessory rail adaptor, and further comprising a flange biasing mechanism carried by the adaptor body and engaging the adaptor flange.

8. A firearm mounting bracket assembly, comprising:

an assembly mount bracket;

an assembly mounting mechanism carried by the assembly mount bracket; wherein the assembly mounting mechanism comprises a ratchet mechanism and an assembly securing strap engaged by the ratchet mechanism, the ratchet mechanism operable to selectively tighten and loosen the assembly securing strap; and an accessory rail adaptor including:

an adaptor body carried by the assembly mount bracket, the adaptor body having a first adaptor body side surface, a second adaptor body side surface opposite the first adaptor body side surface and a firearm attachment surface extending between the first adaptor body side surface and the second adaptor body side surface;

an adaptor roller carried by the first adaptor body side surface of the adaptor body adjacent to the firearm attachment surface;

an adaptor flange carried by the second adaptor body side surface of the adaptor body adjacent to the firearm attachment surface and in spaced-apart relationship to the adaptor roller, the adaptor flange selectively moveable between a locking position oriented toward the adaptor roller and a release position oriented away from the adaptor roller; and a rail lock space formed by and between the firearm attachment surface of the adaptor body, the adaptor roller and the adaptor flange.

9. The firearm mounting bracket assembly of claim 8 wherein the assembly mount bracket comprises a support engaging member and a mounting mechanism plate carried by the support engaging member, and the assembly mounting mechanism is carried by the mounting mechanism plate.

10. The firearm mounting bracket assembly of claim 9 further comprising an accessory rail adaptor mount plate carried by the support engaging member, and wherein the accessory rail adaptor is carried by the accessory rail adaptor mount plate.

11. The firearm mounting bracket assembly of claim 10 further comprising an adaptor mount bracket carried by the accessory rail adaptor mount plate, and wherein the adaptor body of the accessory rail adaptor is carried by the adaptor mount bracket.

12. The firearm mounting bracket assembly of claim 11 wherein the adaptor mount bracket comprises a rotatable bracket pedestal carried by the accessory rail adaptor mount plate and a bracket platform pivotally carried by the bracket pedestal along a first pivot axis, and wherein the adaptor body of the accessory rail adaptor is pivotally carried by the bracket platform along a second pivot axis generally perpendicular to the first pivot axis.

13. The firearm mounting bracket assembly of claim 10 further comprising a first pair of spaced-apart support engaging arms carried by the support engaging member and a second pair of spaced-apart support engaging arms carried by the accessory rail adaptor mount plate.

14. The firearm mounting bracket assembly of claim 8 wherein the adaptor flange is pivotally carried by the adaptor body of the accessory rail adaptor, and further comprising a flange biasing mechanism carried by the adaptor body and engaging the adaptor flange.

15. A firearm mounting bracket assembly, comprising:

an assembly mount bracket including a support engaging member, a mounting mechanism plate carried by the support engaging member, an accessory rail adaptor mount plate carried by the mounting mechanism plate, a first pair of spaced-apart support engaging arms carried by the support engaging member and a second pair of spaced-apart support engaging arms carried by the accessory rail adaptor mount plate;

an assembly mounting mechanism carried by the mounting mechanism plate of the assembly mount bracket; wherein the assembly mounting mechanism comprises a ratchet mechanism and an assembly securing strap engaged by the ratchet mechanism, the ratchet mechanism operable to selectively tighten and loosen the assembly securing strap; and an accessory rail adaptor including:

an adaptor body carried by the assembly mount bracket, the adaptor body having a first adaptor body side surface, a second adaptor body side surface opposite the first adaptor body side surface and a firearm attachment surface extending between the first adaptor body side surface and the second adaptor body side surface;

a pair of spaced-apart roller mount arms carried by the first adaptor body side surface of the adaptor body;

an adaptor roller carried by the roller mount arms adjacent to the firearm attachment surface; and an adaptor flange including an adaptor flange body pivotally carried by the second adaptor body side surface of the adaptor body and an adaptor flange tab protruding from the adaptor flange body and disposed adjacent to the firearm attachment surface and in spaced-apart relationship to the adaptor roller, the adaptor flange selectively pivotal between a locking position with the flange tab oriented toward the adaptor roller and an unlocking position with the flange tab oriented away from the adaptor roller;

a flange biasing mechanism carried by the adaptor body and engaging the adaptor flange body of the adaptor flange, the flange biasing mechanism normally biasing the adaptor flange in the locking position; and a rail lock space formed by and between the firearm attachment surface of the adaptor body, the adaptor roller and the adaptor flange.

16. The firearm mounting bracket assembly of claim 15 further comprising an adaptor mount bracket carried by the accessory rail adaptor mount plate, and wherein the adaptor body of the accessory rail adaptor is carried by the adaptor mount bracket.

17. The firearm mounting bracket assembly of claim 16 wherein the adaptor mount bracket comprises a rotatable bracket pedestal carried by the accessory rail adaptor mount plate and a bracket platform pivotally carried by the bracket pedestal along a first pivot axis, and wherein the adaptor body of the accessory rail adaptor is pivotally carried by the bracket platform along a second pivot axis generally perpendicular to the first pivot axis.

* * * * *